US007201026B2

(12) United States Patent
Yu

(10) Patent No.: US 7,201,026 B2
(45) Date of Patent: Apr. 10, 2007

(54) DUAL-LOCK TYPE PADLOCK

(76) Inventor: Chun Te Yu, No. 253, Sec. 3, Yanhai Rd., Fusing Township, Changhua County 506 (TW)

( * ) Notice: Subject to any disclaimer, the term of this patent is extended or adjusted under 35 U.S.C. 154(b) by 0 days.

(21) Appl. No.: 11/218,643

(22) Filed: Sep. 6, 2005

(65) Prior Publication Data

US 2006/0218980 A1 Oct. 5, 2006

(30) Foreign Application Priority Data

Mar. 30, 2005 (TW) ..... 94204962 U

(51) Int. Cl.
*E05B 37/06* (2006.01)

(52) U.S. Cl. ..... 70/21; 70/25; 70/284; 70/45

(58) Field of Classification Search ..... 70/21–28, 70/284, 285, 432, 312, 45–47
See application file for complete search history.

(56) References Cited

U.S. PATENT DOCUMENTS 4,803,856 A * 2/1989 Ling ..... 70/28
6,792,778 B1 * 9/2004 Chen ..... 70/21
6,860,125 B1 * 3/2005 Yu ..... 70/25
6,877,345 B1 * 4/2005 Misner et al. ..... 70/25
6,928,842 B1 * 8/2005 Huang ..... 70/21
6,997,023 B1 * 2/2006 Huang ..... 70/21
7,007,520 B1 * 3/2006 Lin ..... 70/21
7,007,521 B1 * 3/2006 Misner et al. ..... 70/21
2002/0088256 A1 * 7/2002 Taylor et al. ..... 70/25
2005/0039500 A1 * 2/2005 Yu ..... 70/25
2005/0039501 A1 * 2/2005 Yu ..... 70/29
2005/0235706 A1 * 10/2005 Ling et al. ..... 70/29
2005/0262902 A1 * 12/2005 Ling et al. ..... 70/21
2005/0262903 A1 * 12/2005 Ling et al. ..... 70/21
2006/0032274 A1 * 2/2006 Yu ..... 70/25
2006/0075793 A1 * 4/2006 Yu ..... 70/30
2006/0107708 A1 * 5/2006 Yu ..... 70/21
2006/0107709 A1 * 5/2006 Yu ..... 70/21
2006/0107710 A1 * 5/2006 Yu ..... 70/25
2006/0123857 A1 * 6/2006 Ling et al. ..... 70/21
2006/0130540 A1 * 6/2006 Lin ..... 70/21
2006/0137413 A1 * 6/2006 Yu ..... 70/63
2006/0156769 A1 * 7/2006 Yu ..... 70/21

* cited by examiner

*Primary Examiner*—Suzanne Dino Barrett
(74) *Attorney, Agent, or Firm*—Rosenberg, Klein & Lee

(57) ABSTRACT

A dual-lock type padlock includes a number lock module that is locked and unlocked by a user, and a key lock module that is unlocked by a specific key held by an inspector of the customs for checking the luggage locked by the padlock. Thus, after the key lock module is unlocked, the identification zone of the identification member is exposed outward from the window of the housing, so that the user only needs to see the window to judge if the padlock has been opened by the customs for checking the luggage without having to open the luggage locked by the padlock, thereby greatly saving the time for checking the luggage.

9 Claims, 7 Drawing Sheets

DUAL-LOCK TYPE PADLOCK

BACKGROUND OF THE INVENTION

1. Field of the Invention

The present invention relates to a padlock, and more particularly to a dual-lock type padlock.

2. Description of the Related Art

A conventional padlock in accordance with the prior art was disclosed in the U.S. Pat. No. 6,877,345 and comprises a housing, a shackle, a number lock module, a key lock module, and an indicator. The shackle is movably mounted on the housing. The housing has a window for exposing the indicator which presents a first color in the window. When the key lock module is unlocked, the indicator presents a second color in the window so as to remind the user that the key lock module has been unlocked. When the number lock module is unlocked, the indicator is reset to present the first color in the window.

Another conventional padlock in accordance with the prior art was disclosed in the U.S. Pat. No. 6,381,997 and comprises a housing, and a fixed shackle integrally formed with the housing. However, such a padlock only includes a number lock module without providing a key lock module. In addition, such a padlock is not provided with an indicator.

SUMMARY OF THE INVENTION

The present invention is to mitigate and/or obviate the disadvantage of the conventional padlock.

The primary objective of the present invention is to provide a dual-lock type padlock having a number lock module that is locked and unlocked by a user, and a key lock module that is unlocked by a specific key held by an inspector of the customs for checking the luggage locked by the padlock.

Another objective of the present invention is to provide a padlock, wherein after the key lock module is unlocked, the identification zone of the identification member is exposed outward from the window of the housing, so that the user only needs to see the window to judge if the padlock has been opened by the customs for checking the luggage without having to open the luggage locked by the padlock, thereby greatly saving the time for checking the luggage.

A further objective of the present invention is to provide a padlock, wherein the user can see directly through the window to inspect if contents of the luggage that has been checked are missing or lost so that the user only needs to inspect the luggage that has been checked without having to inspect the luggage that has never been checked.

In accordance with the present invention, there is provided a dual-lock type padlock, comprising:

a housing having a shackle, and an opening formed between one end of the shackle and the housing;

a limit member having a first end pivotally mounted in the housing in a swingable manner and a second end movable to open or close the opening in a swingable manner;

a number lock module mounted in the housing and disposed between an unlocked state to allow a swinging motion of the limit member and a locked state to limit the swinging motion of the limit member;

a key lock module mounted in the limit member and having a locking barrel and a push member, wherein the locking barrel is rotated by a specific key, and the push member of the key lock module is driven by the locking barrel to move between an unlocked position where the push member is detached from a side of the number lock module and a locked position where the push member is rested on the side of the number lock module.

Further benefits and advantages of the present invention will become apparent after a careful reading of the detailed description with appropriate reference to the accompanying drawings.

DETAILED DESCRIPTION OF THE INVENTION

Figure 1:
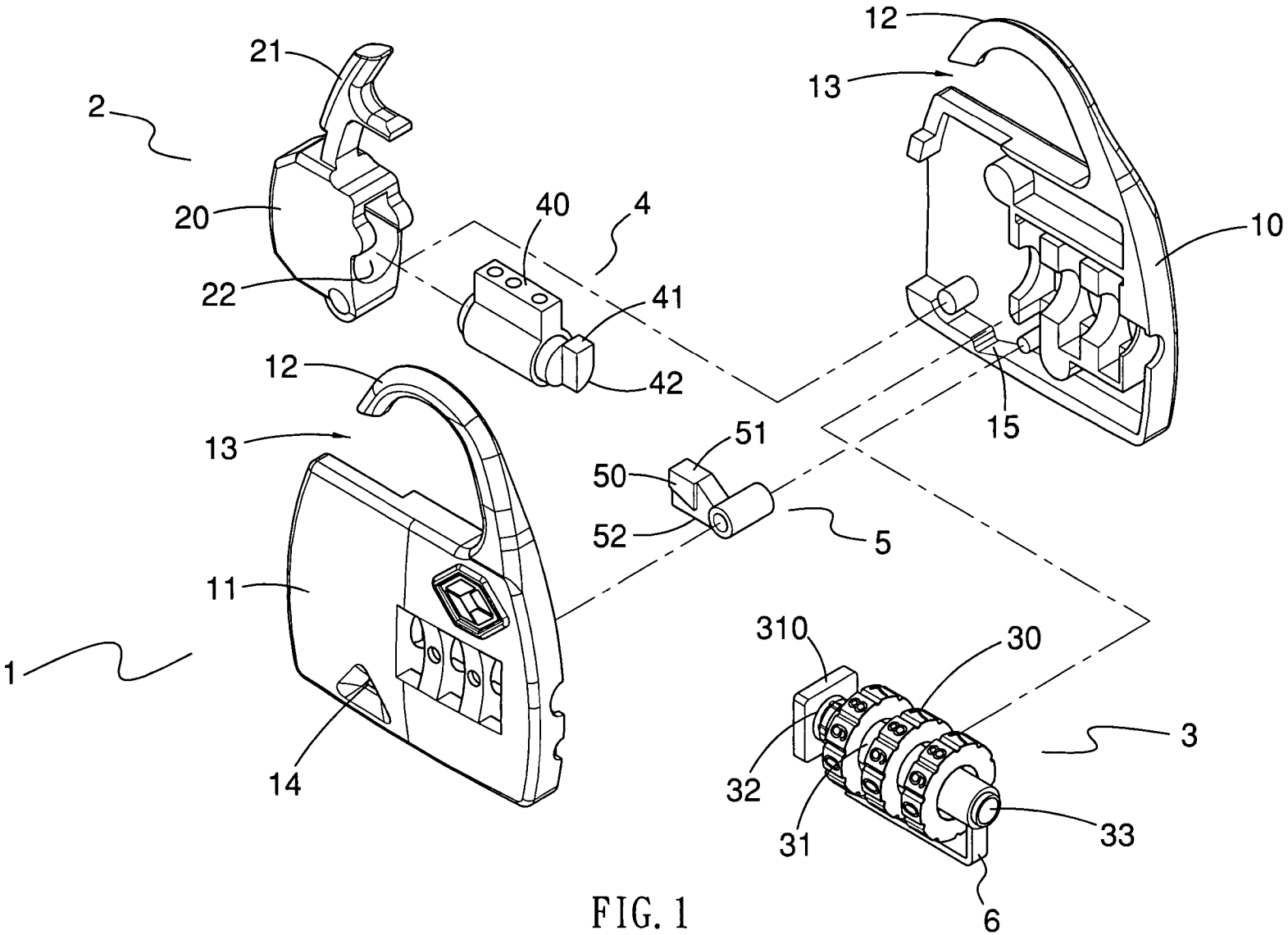
FIG. 1 is an exploded perspective view of a padlock in accordance with the preferred embodiment of the present invention.

Referring to the drawings and initially to FIG. 1, a dual-lock type padlock in accordance with the preferred embodiment of the present invention comprises a housing 1, a limit member 2, a number lock module 3, a key lock module 4, an identification member 5, and a restoring member 6.

The housing 1 consists of a right shell 10 and a left shell 11 combined with each other. The housing 1 has an upper side integrally formed with a shackle 12, and an opening 13 is formed between one end of the shackle 12 and the housing 1. The left shell 11 of the housing 1 has a window 14 extended through the left shell 11. The housing 1 has an inside having a bottom formed with a slot 15.

The limit member 2 includes a press portion 20 and a locking portion 21. The press portion 20 of the limit member 2 has a bottom pivotally mounted on the housing 1 in a swingable manner. The press portion 20 of the limit member 2 has a side protruding outward from the housing 1. The press portion 20 of the limit member 2 has an inside formed with a recess 22. The locking portion 21 of the limit member 2 is extended from an upper side of the press portion 20 and is movable to open or close the opening 13 in a swingable manner.

The number lock module 3 is mounted in the housing 1 and includes a number wheel unit 30, a shaft 31, an elastic member 32, and a reset button 33. The number wheel unit 30 of the number lock module 3 allows or limits axial displacement of the shaft 31 by a set of combination. The shaft 31 of the number lock module 3 is extended through the number wheel unit 30 and has a first end provided with a push block 310. The elastic member 32 of the number lock module 3 is mounted on the shaft 31 and has a first end rested on the back face of the push block 310 and a second end rested on the side face of the number wheel unit 30. The reset button 33 of the number lock module 3 is mounted on a second end of the shaft 31 and exposed outward from the housing 1. Thus, when the number wheel unit 30 is disposed at the unlocked state, the reset button 33 is driven by an external force to move axially.

The key lock module 4 includes a locking barrel 40 and a push member 41. The locking barrel 40 of the key lock module 4 is mounted in the recess 22 of the press portion 20 of the limit member 2 and has a first end exposed outward from the press portion 20 of the limit member 2 to allow insertion of a specified key which can drive and rotate the locking barrel 40. The push member 41 of the key lock module 4 is mounted on a second end of the locking barrel 40. Thus, the push member 41 of the key lock module 4 is driven by the locking barrel 40 to move between an unlocked position where the push member 41 is detached from a side of the push block 310 of the shaft 31 of the number lock module 3 and a locked position where the end face of the push member 41 is rested on a side of the push block 310 of the shaft 31 of the number lock module 3. The push member 41 of the key lock module 4 has a side formed with a slope 42.

The identification member 5 is pivotally mounted in the housing 1 in a swingable manner. The identification member 5 has an identification zone 50, a first surface 51 and a second surface 52. The identification zone 50 of the identification member 5 is moved with the identification member 5 to expose outward from the window 14 of the housing 1 or detach from the window 14 of the housing 1. The first surface 51 of the identification member 5 is pushed by the slope 42 of the push member 41 of the key lock module 4.

The restoring member 6 is mounted in the housing 1 and has a first end secured to the reset button 33 of the number lock module 3 and a second end extended to a position located under the identification member 5 to push the second surface 52 of the identification member 5.

Figure 2:
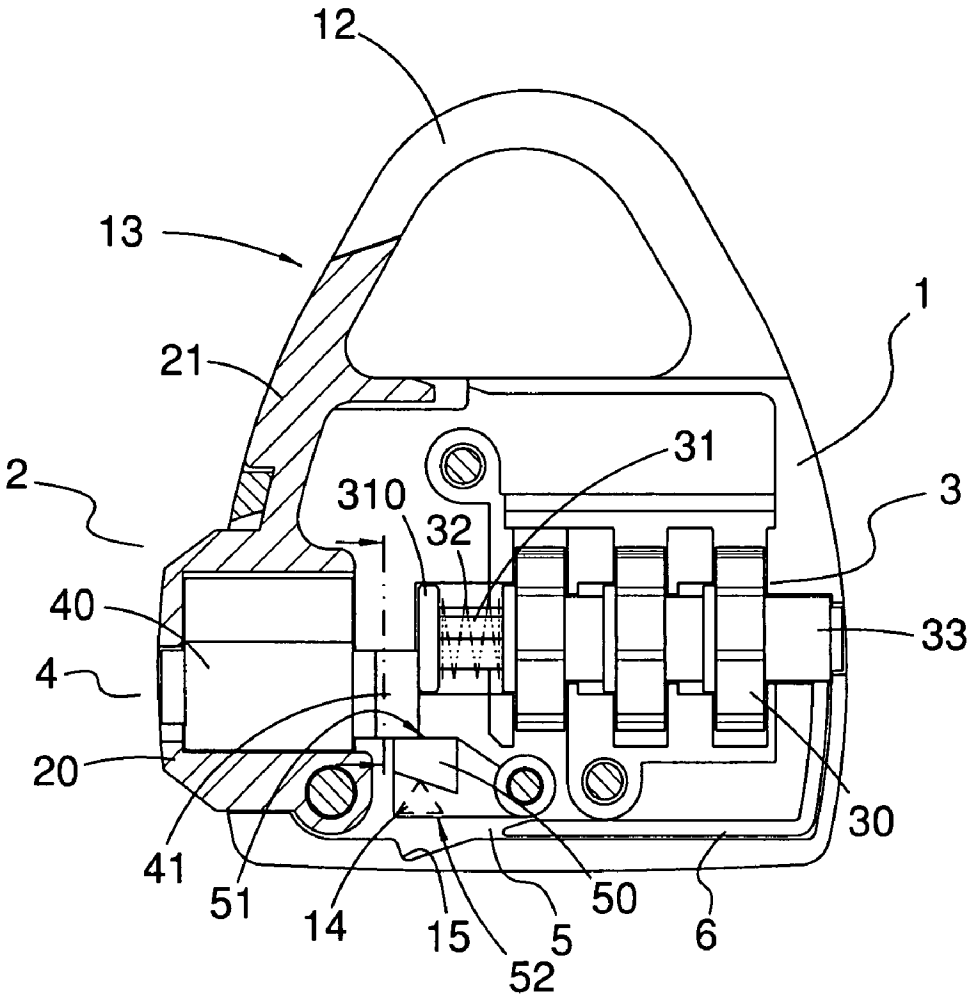
FIG. 2 is a plan cross-sectional assembly view of the padlock as shown in FIG. 1.
Figure 2A:
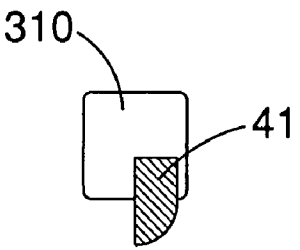
FIG. 2A is a partial enlarged view of the padlock as shown in FIG. 2.

Referring to FIGS. 2 and 2A, when the number wheel unit 30 is disposed at the locked state, and the locking barrel 40 of the key lock module 4 is not rotated by the specific key, the shaft 31 cannot be moved axially. At the same time, the end face of the push member 41 is rested on a side of the push block 310 of the number lock module 3, so that the limit member 2 cannot swing, and the opening 13 is closed, thereby forming the locked state.

Figure 3:
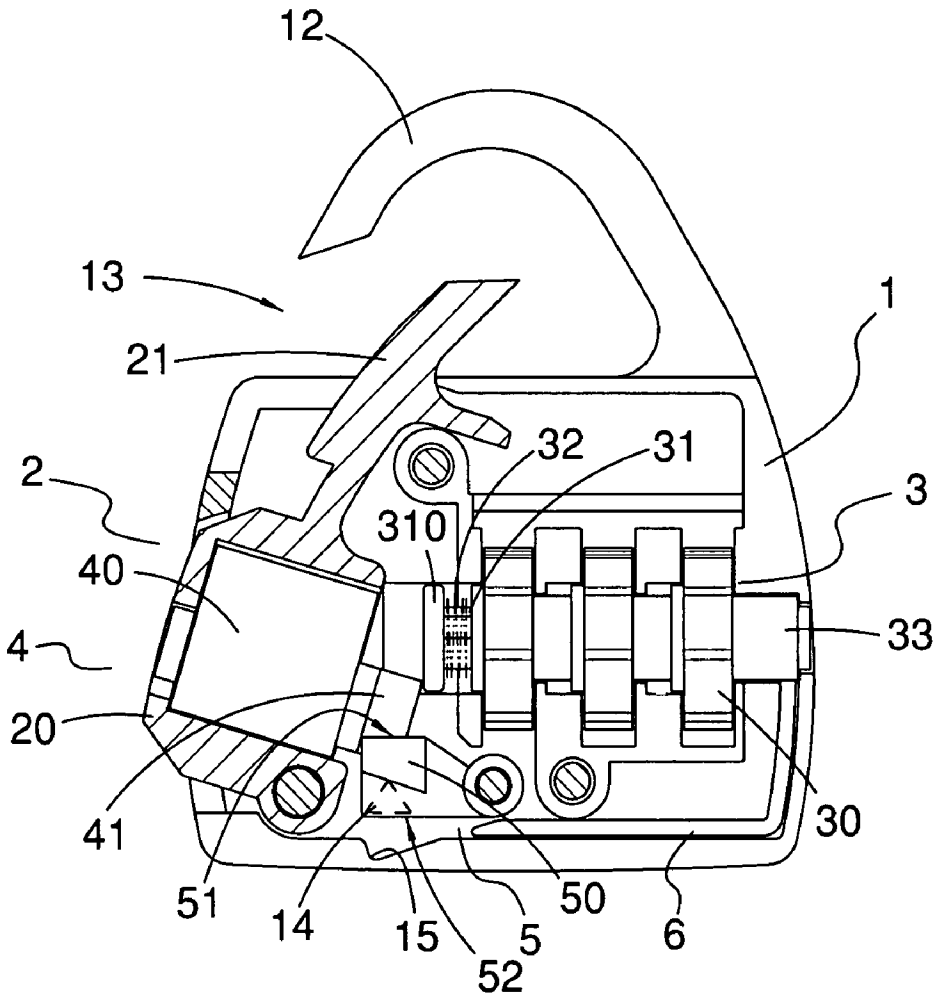
FIG. 3 is a schematic operational view of the padlock as shown in FIG. 2.

Referring to FIG. 3, when the number wheel unit 30 is disposed at the unlocked state, the shaft 31 can be moved axially. Thus, the press portion 20 of the limit member 2 can be pressed to drive the push member 41 to push and move the push block 310 of the number lock module 3, and the locking portion 21 of the limit member 2 can be moved to open the opening 13, thereby forming the unlocked state.

Figure 4:
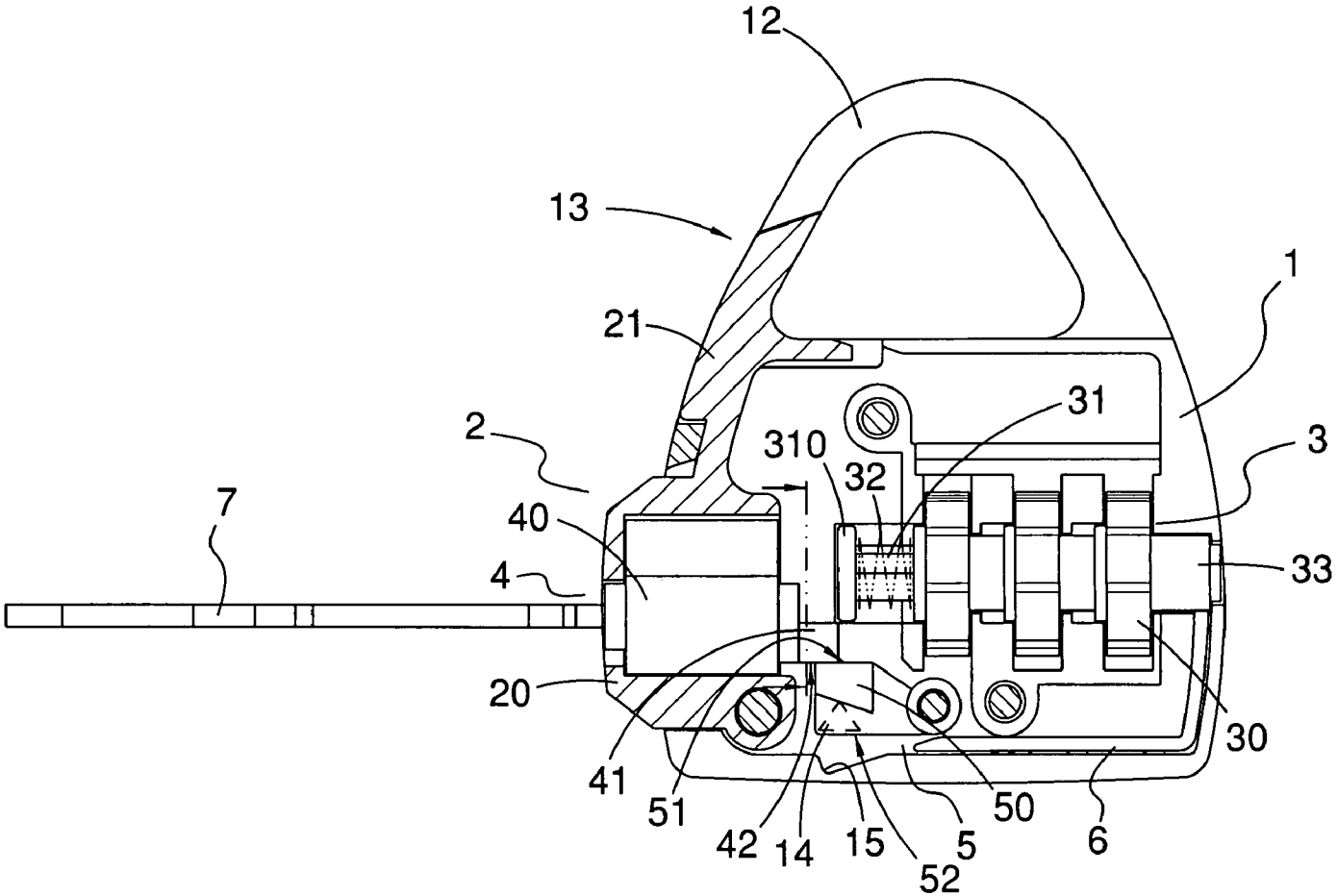
FIG. 4 is a schematic operational view of the padlock as shown in FIG. 2.
Figure 4A:
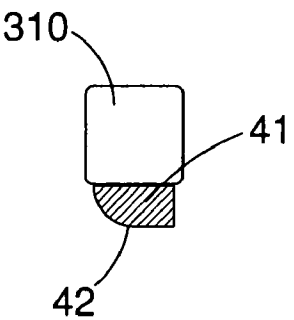
FIG. 4A is a partial enlarged view of the padlock as shown in FIG. 4.

Referring to FIGS. 4 and 4A, when the number wheel unit 30 is disposed at the locked state, the shaft 31 cannot be moved axially. At this time, the locking barrel 40 of the key lock module 4 is rotated by the specific key 7, so that the push member 41 is rotated downward through 90 degrees to detach from the push block 310 of the number lock module 3, and the slope 42 of the push member 41 is rested on the first surface 51 of the identification member 5. Thus, the push member 41 is released from the push block 310 of the number lock module 3, and the limit member 2 will not be stopped by the push block 310 of the number lock module 3.

Figure 5:
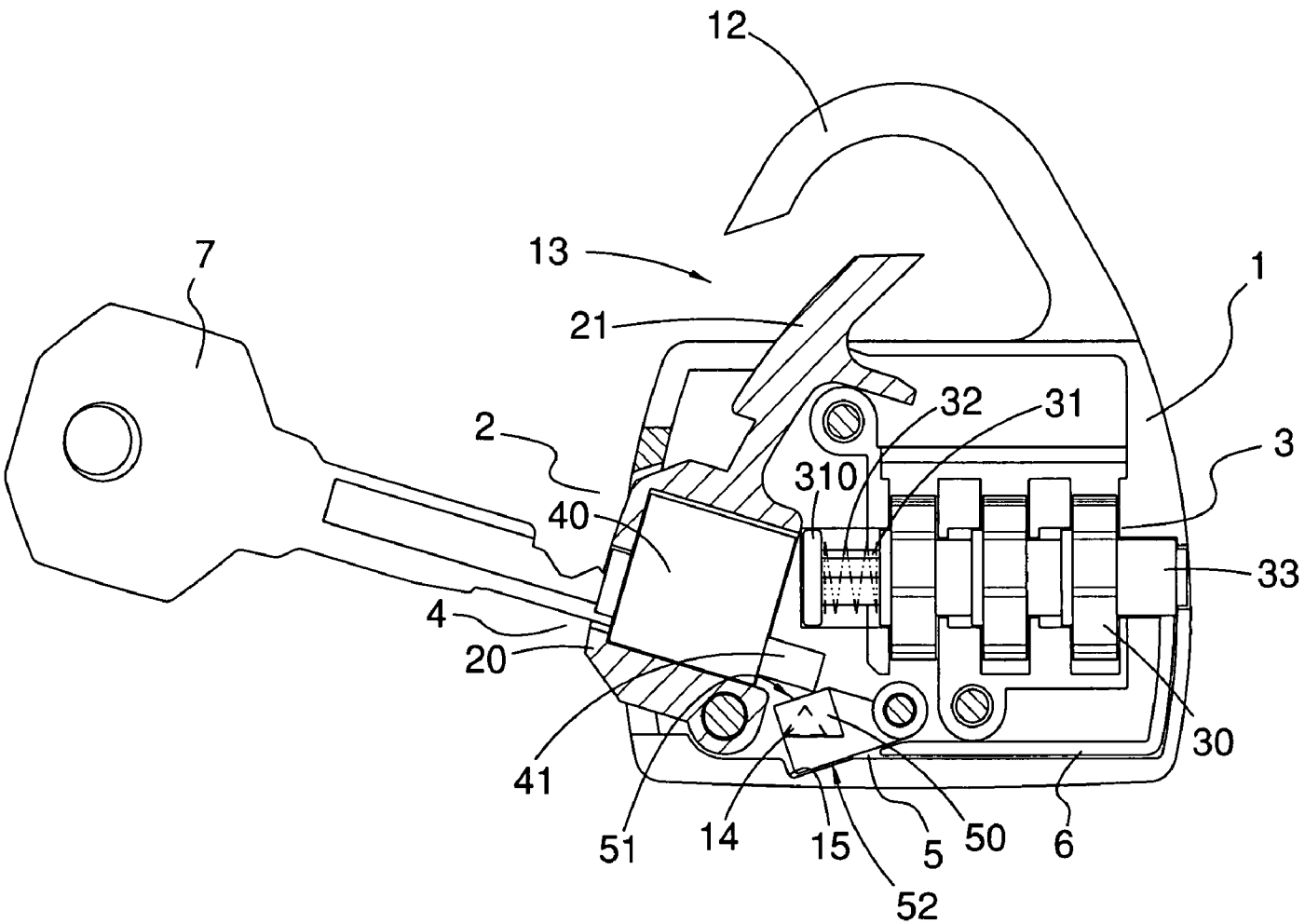
FIG. 5 is a schematic operational view of the padlock as shown in FIG. 4.

Referring to FIG. 5, the push member 41 is released from the push block 310 of the number lock module 3, the press portion 20 of the limit member 2 can be pressed to move the locking portion 21 of the limit member 2 to open the opening 13, thereby forming the unlocked state. At the same time, the push member 41 swings with the limit member 2 to push the identification member 5 which swings to abut the slot 15 of the housing 1, so that the identification zone 50 of the identification member 5 is moved with the identification member 5 to expose outward from the window 14 of the housing 1. Thus, the user can directly and easily judge from the window 14 if the key lock module 4 has been unlocked.

Figure 6:
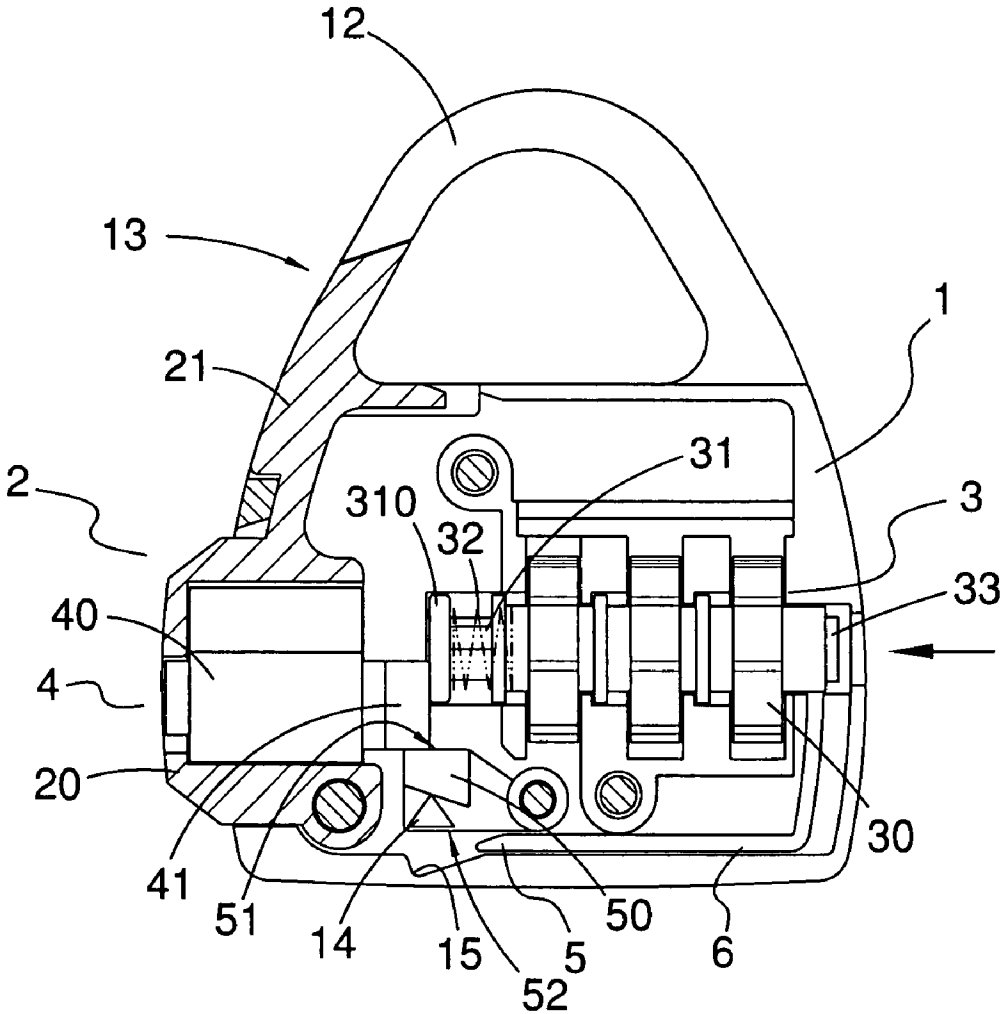
FIG. 6 is a schematic operational view of the padlock as shown in FIG. 2.

Referring to FIG. 6, when the number wheel unit 30 is disposed at the unlocked state, the shaft 31 can be moved axially. Thus, the reset button 33 of the number lock module 3 is pressed by an external force to move inward axially so as to change the combination of the number wheel unit 30. When the reset button 33 of the number lock module 3 is pressed to move inward, the restoring member 6 is moved with the reset button 33 of the number lock module 3 to push the second surface 52 of the identification member 5, so that the identification member 5 is pushed to return to the original position, thereby detaching the identification zone 50 of the identification member 5 from the window 14 of the housing 1.

Accordingly, after the key lock module 4 is unlocked, the identification zone 50 of the identification member 5 is exposed outward from the window 14 of the housing 1. Thus, the user only needs to see the window 14 to directly judge if the padlock has been opened by the customs for checking the luggage without having to open the luggage locked by the padlock, thereby greatly saving the time for checking the luggage. In addition, the user can directly see the window 14 to inspect if contents of the luggage that has been checked are missed or lost so that the user only needs to inspect the luggage that has been checked without having to inspect the luggage that has never been checked.

Figure 7:
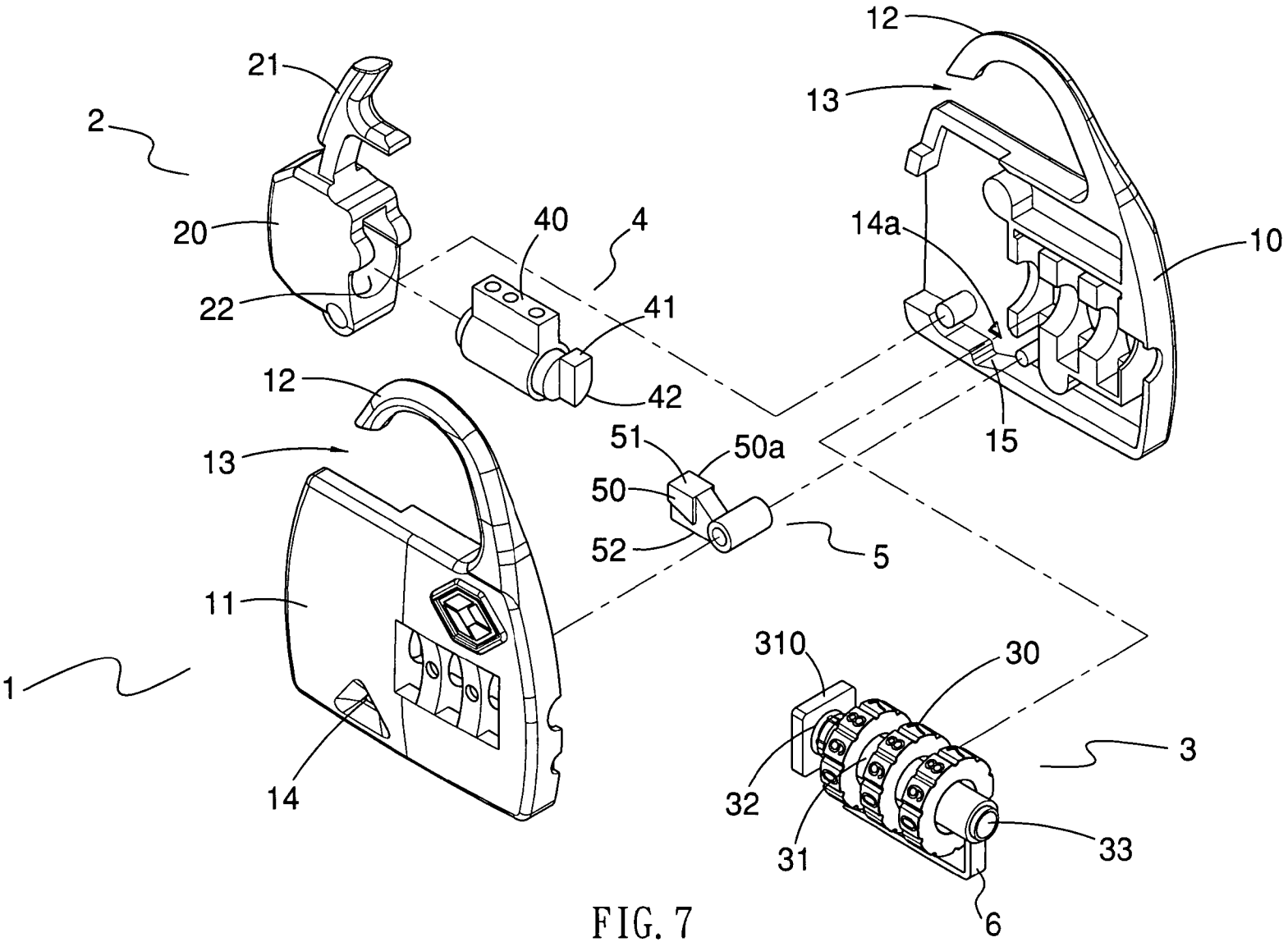
FIG. 7 is an exploded perspective view of a padlock in accordance with another preferred embodiment of the present invention.

Referring to FIG. 7, the right shell 10 of the housing 1 has a secondary window 14*a* aligning with the window 14 of the left shell 11, and the identification member 5 has a secondary identification zone 50 aligning with the secondary window 14*a*.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A dual-lock type padlock comprising:

a housing having a shackle, and an opening formed between one end of the shackle and the housing;

a limit member including a press portion and a locking portion, wherein the press portion having an end pivotally mounted in the housing in a swingable manner, a side protruding from the housing and an inside formed with a recess, and the locking portion is extended from the side of the press portion and movable to open or close the opening in a swingable manner;

a number lock module mounted in the housing and disposed between an unlocked state to allow a swinging motion of the limit member and a locked state to limit the swinging motion of the limit member;

a key lock module mounted in the limit member and having a locking barrel and a push member, wherein the locking barrel comprises an end disposed in the recess of the press portion and another end exposed from the recess of the press portion of the limit member for receiving a specified key which can drive the locking barrel, and the push member of the key lock module is driven by the locking barrel between an unlocked position where the push member is detached from a side of the number lock module and a locked position where the push member is rested on the side of the number lock module.

2. The dual-lock type padlock in accordance with claim 1, wherein the housing has a window extended into an inside thereof, and the dual-lock type padlock further comprises an identification member, and a restoring member, wherein:

the identification member is mounted in the housing and has an identification zone so that when the push member of the key lock module is disposed at the unlocked position, the identification zone is moved with the identification member by a swinging motion of the limit member to expose outward from the window of the housing;

the restoring member is mounted in the housing and driven by an external force when the number lock module is disposed at the unlocked state to push the identification member to detach the identification zone from the window of the housing.

3. The dual-lock type padlock in accordance with claim 2, wherein the number lock module includes a number wheel unit, a shaft, and an elastic member, the number wheel unit allows or limits axial displacement of the shaft by a set of combination, the shaft is extended through the number wheel unit and has an end rested on an end face of the push member, and the elastic member is rested on the shaft to provide a restoring force to the shaft.

4. The dual-lock type padlock in accordance with claim 3, wherein the shaft is provided with a push block rested on the end face of the push member, and the elastic member is mounted on the shaft and has a first end rested on a back face of the push block and a second end rested on a side face of the number wheel unit.

5. The dual-lock type padlock in accordance with claim 3, wherein the number lock module further includes a reset button mounted on a second end of the shaft and exposed outward from the housing, so that when the number lock module is disposed at the unlocked state, the reset button is driven by an external force to move axially to change the combination of the number lock module, and the restoring member is moved with the reset button synchronously.

6. The dual-lock type padlock in accordance with claim 5, wherein the restoring member has an end secured to the reset button of the number lock module.

7. The dual-lock type padlock in accordance with claim 2, wherein the identification member is pivotally mounted in the housing in a swingable manner, the housing has a slot for positioning the identification member, so that the identification zone is exposed outward from the window of the housing, the identification member has a first surface and a second surface located at two opposite sides thereof the first surface of the identification member is pushed by the push member of the key lock module to move the identification member so that the identification zone is moved to expose outward from the window of the housing, and the second surface of the identification member is pushed by the restoring member to return the identification member so that the identification zone is moved to detach from the window of the housing.

8. The dual-lock type padlock in accordance with claim 2, wherein the push member of the key lock module has a side formed with a slope, and the first surface of the identification member is pushed by the slope of the push member of the key lock module.

9. The dual-lock type padlock in accordance with claim 2, wherein the housing has two windows, and the identification member has two identification zones aligning with the two windows.

* * * * *